US006408539B1

(12) United States Patent
Voth et al.

(10) Patent No.: US 6,408,539 B1
(45) Date of Patent: Jun. 25, 2002

(54) METHOD OF CONTINUOUS THERMAL TREATMENT OF A TEXTILE PRODUCT WEB, AND A DRYER THEREFOR

(75) Inventors: Marc-Aurel Voth, Hamburg; Andreas Stroehrmann, Witzeeze, both of (DE)

(73) Assignee: Babcock-Textilmaschinen GmbH, Seevetal (DE)

( * ) Notice: Subject to any disclaimer, the term of this patent is extended or adjusted under 35 U.S.C. 154(b) by 0 days.

(21) Appl. No.: 09/580,262

(22) Filed: May 26, 2000

(30) Foreign Application Priority Data

Mar. 28, 1999 (DE) ..... 199 24 704

(51) Int. Cl.[7] ..... F26B 3/00
(52) U.S. Cl. ..... 34/444; 34/508
(58) Field of Search ..... 34/60, 444, 454, 34/636, 638, 508; 8/151.2, 149.1; 75/75; 28/122; 68/5 D

(56) References Cited

U.S. PATENT DOCUMENTS

| | | | | | |
|---|---|---|---|---|---|
| 3,927,971 | A | * | 12/1975 | Meier-Windhorst | 8/151.2 |
| 3,943,613 | A | * | 3/1976 | Schraud et al. | 28/122 |
| 4,026,035 | A | * | 5/1977 | Dyer et al. | 34/454 |
| 4,052,796 | A | * | 10/1977 | Arendt | 34/60 |
| 4,075,875 | A | * | 2/1978 | Heidan | 68/5 D |
| 4,532,797 | A | * | 8/1985 | Yang | 75/75 |
| 4,621,440 | A | * | 11/1986 | Gierse et al. | 34/638 |
| 4,817,299 | A | * | 4/1989 | Pabst | 34/636 |
| 5,231,773 | A | * | 8/1993 | Pabst | 34/508 |
| 5,408,715 | A | * | 4/1995 | Keller et al. | 8/149.1 |

FOREIGN PATENT DOCUMENTS

| | | | | |
|---|---|---|---|---|
| DE | 952 617 | | 11/1956 | |
| DE | 25 45 440 | | 4/1977 | |
| DE | 0556417 | * | 2/1992 | F26B/25/00 |
| DE | 195 46 344 A1 | | 6/1997 | |

* cited by examiner

*Primary Examiner*—Teresa Walberg
*Assistant Examiner*—Leonid M Fastovsky
(74) *Attorney, Agent, or Firm*—Michael J. Striker

(57) ABSTRACT

A method of continuos thermal treatment of a textile product web has the steps of bringing a product web in contact with a treatment gas guided in a circulating process, introducing a product web into a steam portion having one or several steam stages in which heat steam is used as a treatment gas, introducing the product web into a steam-air portion which has one or several stages and hot steam and heated air as a treatment gas, passing the product web first through the steam portion and subsequently through the steam air portion, providing an exchange of the treatment gas between the steam stages and the stages, adjusting a relative moisture of the hot steam of the steam stages of the steam portion to the value zero, and performing the adjusting by measuring relative moistures of a first and a last steam stages and changing discharge gas quantities of the first or second steam stages and one further stage.

15 Claims, 2 Drawing Sheets

METHOD OF CONTINUOUS THERMAL TREATMENT OF A TEXTILE PRODUCT WEB, AND A DRYER THEREFOR

BACKGROUND OF THE INVENTION

The present invention relates to a method of continuous thermal treatment of a textile product web as well as to a dryer for performing the method.

For continuous thermal treatment of a textile product web, such as drying, drying and/or fixing, it is known to bring the product web in several successive steps in contact with a treatment gas of a corresponding temperature. Such a thermal treatment can be performed in a drying and fixing device disclosed in the German patent document DE A 25 45 440, in particular for textile webs which are fed there by their width.

A dryer, such as a tender dryer, has fields which are arranged one after the other and corresponds to the treatment stages. In each field or in each stage, the treatment gas is guided in a circulating process.

In many cases, heated air is used as the treatment gas. It is also known to use steam as the treatment gas, as disclosed for example in the German patent document DE-A 195 46 344.

A method which utilizes both the advantages of a treatment with heated air and also a treatment with steam, and a corresponding dryer, are disclosed in the German patent document DE-B 95 26 17. In this process for drying of continuous material webs, the product is treated in successive portions of the drying machine alternatingly with heated air and overheated steam. The portions of the drying machine can include several chambers which are also the above mentioned fields. For subdividing the treatment into these portions, the machine is subdivided for example by partitions into successive treatment zones with air or steam as a drying medium.

These processes have however the disadvantage that for different application cases a new dryer is needed. At least, the partitions must be displaced.

SUMMARY OF THE INVENTION

Accordingly, it is an object of the present invention to provide a method for continuous thermal treatment of a textile product web which avoids the disadvantages of the prior art.

In keeping with these objects and with others which will become apparent hereinafter, one feature of present invention resides, briefly stated in a method which includes the steps of bringing a product web in contact with a treatment gas guided in a circulating process, introducing a product web into a steam portion having one or several steam stages in which heat steam is used as a treatment gas, introducing the product web into a steam-air portion which has one or several stages and hot steam and heated air as a treatment gas, passing the product web first through the steam portion and subsequently through the steam air portion, providing an exchange of the treatment gas between the steam stages and the stages, adjusting a relative moisture of the hot steam of the steam stages of the steam portion to the value zero, and performing the adjusting by measuring relative moistures of a first and a last steam stage and changing discharge gas quantities of the first or second steam stages and one further stage.

It is another object of the present invention to provide a dryer which can implement the inventive method.

In keeping with these objects, a dryer is proposed which has a steam-tight housing through which a product web is transportable; at least two successively arranged fields each provided with a circulating device for a treatment gas; moisture sensors arranged in first fields and in at least one rear field; a discharge conduit provided with an adjusting arrangement and arranged at least in a first or a second field and in at least one further field correspondingly; a switching unit through which at least two of said moisture sensors are connected; said switching unit being connected with at least one adjusting device.

When the method is performed and the dryer is designed in accordance with the present invention, various application cases can be realized without significant conversion expenses of the dryer.

In the inventive method for continuous thermal treatment of a textile product web, the product web passes first through one or several steam portions which have steam stages, in which hot steam is used as a treatment gas, and subsequently it passes through one or several air portions which have steam and in which steam and in which hot steam and heated air are used as the treatment gas. Subsequently to the steam-air portion, it can pass in some cases through an air portion with one or several stages in which it is brought into contact with heated air. The number of the steam stages of the steam portion are selected in dependence on the treatment process, wherein for drying there is a tendency for rather more steam stages for drying and fixing and in some cases less steam stages, and for fixing for example only one steam stage is utilized.

A treatment with steam has the advantage that the product web is heated very fast to a temperature of up to 100° C.

With the steam portion during a thermal treatment of a product web, the shrinkage which requires a certain moisture and is enhanced by high temperature of the product web is facilitated. The product web which has approximately input moisture and is heated to 100° C. is dried at this temperature. It has during shrinkage this high temperature at a moisture of approximately 30%. If the treatment gas to the contrary has a lower steam content, then the product web during the drying has a lower cooling limiting temperature corresponding to the steam content. An improved shrinkage during drying has for example an additional shrinkage treatment such as tumbling.

In the inventive method the relative moisture or in other words the volume of the water steam with respect to the volume of the treatment gas is adjusted to the steam stages of the steam portion to the value 1. A relative moisture with the value 1 corresponds to a treatment gas which has up to 100 of saturated, mainly overheated water steam, identified as a hot steam. In guarantees a fast warming of the product web to 100° C.

In principle it is known to adjust the moisture of the treatment gas. In the above mentioned German patent document DE-A 25 45 440 it is described that during drying the steam content which corresponds to the relative moisture is held constant by controlling the fresh air supply in the individual fields. In addition a temperature sensor regulates the discharge air quantity. A steam content of 100° C. adjusted by the regulation of the fresh air supply; is basically not possible. Each fresh air supply would reduce the steam content to the value under 100%. A fresh air supply in the fields operating with hot steam is excluded because of the condensation danger.

This document also discloses a simplifying embodiment, in which during drying the discharge airfans which determine the discharge air quantity are controlled by a steam content sensor. The discharge air fans are connected with several fields. The disadvantage of this method is that the steam content can be regulated only together for the fields connected to one discharge air fan. Thereby the number of the steam fields and correspondingly the number of the steam stages are fixed.

In accordance with the present invention, the relative moisture of the hot steam of the steam stages of the steam portion is adjusted to the value 1, in that the moisture of the treatment gas, in other words the hot steam, of the first and the last steam stage is measured and the discharge gas of the first or the second steam stage and one further stage is changed. This method has the advantage that independently from the number of the steam stages, only two discharge gas quantities are changed.

In a dryer which is suitable for performing the method, corresponding discharge gas conduits only for two fields are needed. It is important that in accordance with the present invention in this open process, or in other words with an exchange of a treatment gas between the stages and thereby between the fields, the discharge gas is discharged only in two fields, while the quantities are changed due to the measured relative moisture.

When compared with a discharge gas control of each stage, with the inventive method both the structural expenses and the operational expenses are substantially reduced. The temperature of the treatment gasses guided in the circulation process are adjusted separately in individual stages.

In accordance with another feature of present invention, the relative moisture of the steam stage is adjusted to the value 1 and relative moisture of all remaining stages is adjusted to a predetermined value in that the relative moisture of the steam stages and at least one further stage are measured and the discharge quantity of the steam stage and at least one further stage are changed. In this process the steam portion includes only one steam stage. This is suitable especially well for fixing. The for example dry product web is heated in the first stage formed as the steam stage very fast to 100° C., so that subsequently in steam-air stages or air stages it can be further heated to the temperature required for fixing for example of the applied paint.

For a measurement of two relative moistures, namely of the steam stage and a further stage and changing of two discharge gas quantities, namely of the steam stage and a further stage, which can be different from the stage in which the moisture is measured, the relative moisture of the product web is adjusted to the value 1 and the relative moisture of all other stages is adjusted to predetermined values. This method makes possible with relative expenses the adjustment of moisture in all treatment stages.

In accordance with a further embodiment of the process, the steam portion includes at least three steam stages. Two and more steam stages are especially well for drying, and drying and fixing. In this method additionally the moisture of a steam-air stage is measured and additionally the discharge gas quantity of a further steam stage or a further stage is changed. This method makes possible the adjustment of moisture in all stages with at least two steam stages by three moisture measurements and three changes of the discharge gas quantities.

In accordance with a further feature of the present invention, the discharge gas quantities of the first and the second steam stage and one further stage are changed. The change of the discharging gas quantities of the successive stages has the structural advantage that the discharge gas conduits of the corresponding fields of a dryer are arranged one after the other and for example only one joint discharge gas fan is required.

In accordance with another feature of the present invention a change of the discharge gas quantity of the last stage guarantees that also, up to the last stage, the moisture of the stages can be adjusted to the predetermined value. The last field which corresponds to the last stage of a dryer is often better accessible than the front fields.

In accordance with still a further feature of the present invention, from structural and operational reasons, similarly as in the case of both first stages, it is of advantage when the discharge gas quantities of both last stages arranged one after the other are changed. In a still further embodiment of the present invention also four relative moistures can be measured and four discharge gas quantities can be changed. This is of advantage, the longer is the treatment, or in other words more stages are available, and the more accurate the relative moistures are adjusted for efficient thermal treatment. In the inventive method up to 80% of the treatment stages can be formed as steam stages. This provides for a flexibility of the method.

In a dryer which is suitable for the method of the present invention, in all fields or in the first fields, such as the fields which are operated as steam fields, and in at least one of the rear fields, moisture sensors are arranged. The moisture sensors have each a measuring unit in the interior of the field and a measuring device connected with it and located outside of the field. The first and second field and a rear field have correspondingly a discharge conduit provided with an adjustment device. An adjustment device includes for example a flap integrated in the discharge gas conduit and connected to an adjusting unit or a regulator. Depending on which of the first fields are used as steam fields, the moisture sensors are connected through the switching unit with the adjusting devices of the discharge gas conduits. The first and/or last moisture sensors can be also directly connected with the adjusting devices of the discharge gas conduits, such a dryer can operate with one, two or more steam fields, which makes possible a great number of various methods.

For performing the method it is advantageous to make possible measurements of the relative moisture of the last steam stages. This is performed in accordance with the another feature of the present invention by the moisture sensors of all first fields or in other words all possible steam fields connected with the switching movement. The moisture sensor of the first field can be connected directly with the adjusting device of the discharge gas conduit of the first field.

In accordance with still a further feature of the present invention, moisture sensors are arranged in all of the fields. It increases the flexibility of the dryer and the accuracy, of which the moisture of the stages can be adjusted.

In a further feature of the present invention, all moisture sensors are connected to the switching unit and is connected with the adjusting devices so that it is possible to provide a central, in some cases computerized control of the thermal treatment in the dryer.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
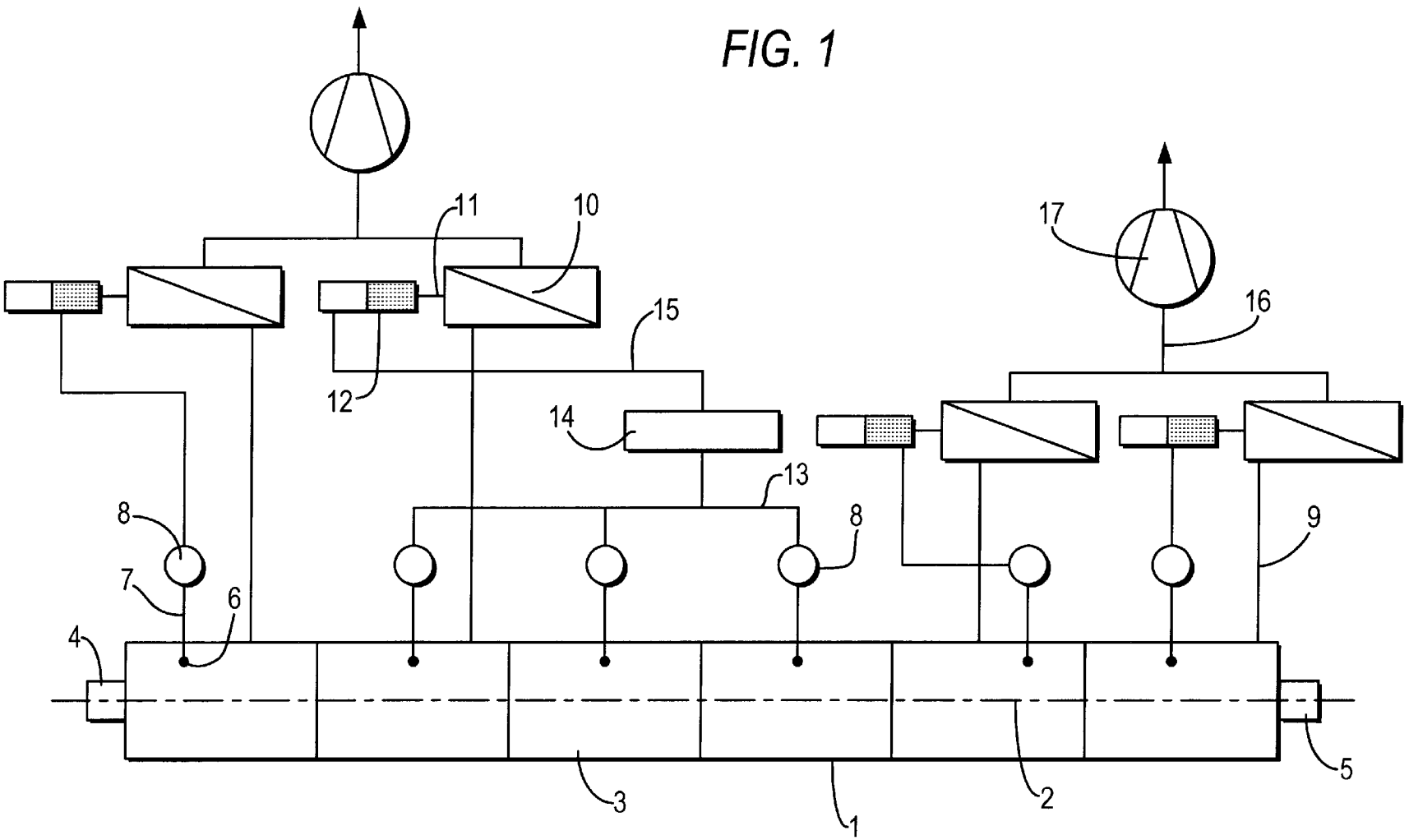
FIG. 1 is a simplified side view of a dryer in accordance with a first embodiment of the present invention.

The dryer for a continuous thermal treatment of a textile product web shown in FIG. 1 has a steam-tight housing 1, a not shown transporting device for transporting a textile product web 2, and is subdivided into at least two successive fields 3. The dryer has six successive fields 3, with each field 3 provided with a circulating device for treatment gas. An inlet lock 4 is located at the front end of the dryer and an outlet lock 5 is located at a rear end of the dryer. The dryer with its transporting device, its fields 3 and its locks 4 and 5 can be formed as the dryer in the German patent document DE 198 58 839.

Moisture sensors are arranged in the first fields 3 and at least in one rear field 3. In this example the moisture sensors are arranged in the six fields 3. A moisture sensor has a measuring unit 6 in the interior of the field 3 and a measuring device 8 located outside the fields 3 and connected with the measuring unit through a conduit 7.

At least the first or second field 3 and the rear field 3 are provided with a discharge gas conduit 9. In this example the first and second and the fifth and sixth, or in other words the last and the pan ultimate field 3 are provided with a discharge gas conduit 9. Each discharge gas conduit 9 is associated with an adjusting device with a flap 10 arranged in the gas discharge conduit 9 and an adjusting unit 12 connected with the flap 10 through a conduit 11. Instead of the flap 10, also another device can be integrated in the gas discharge conduit 9 for changing the discharge gas quantity. The adjusting unit 10 can have also a regulator.

The measuring devices 8 of the moisture sensors of the first, the pan ultimate and the last fields 3 are connected directly with the adjusting units 12 of the discharge gas conduits 9 of the corresponding fields 3. The measuring devices 8 of the moisture sensors of the second, third and fourth fields 3, or in other words the central fields 3, are connected through conduits 13 to a switching unit 14. The switching unit 14 is connected through a conduit 15 of the adjusting unit 12 to the discharge conduit 9 of the second field 3. The discharge conduits 9 of the both first fields 3 and the both last fields 3 open correspondingly into a joint conduit 16 which leads to a discharge fan 17.

In operation the textile product web 2 passes through the dryer with a speed of for example 40–100 m per minute. For thermal treatment, it is both in contact with the treatment gas which is guided in a circulating process. It passes first through one or several steam stages of a steam portion, in which hot steam is introduced as the treatment gas, and subsequently passes through one or several stages of a steam-air portion in which hot steam and heated air are introduced as the treatment gas. The fields of the dryer allow an exchange of the treatment gasses between the fields. In other words a part of the treatment gasses supplied in individual fields (stages) can flow into the preceding or into the subsequent field. The flow direction is dependent from the pressure conditions in the dryer.

The dryer makes possible a drying, and drying and fixing, or a fixing of the product web 2. Depending on the desired method, the treatment parameters, such as the relative moisture of the treatment gas, is fixed in the stage of the portion. Because of this value, in particular the relative moisture of the treatment gasses, the quantities of the discharge steam of the steam stages and the corresponding quantities of the discharge gasses are determined from hot steam and air of the stages of the steam-air portion, and after starting of the dryer adjusted on the adjusting devices of the discharge gas conduits. Based on further operational parameter, such as the inlet moisture of the product web 2, it is possible to vary in operation the discharge gas quantity in correspondence with the established relative moistures. For accurate adjustment of the established relative moistures, at least the relative moistures in the first and the last steam stages are measured, and at least the discharge quantities of the first or second steam stages and a further stage are changed.

An example of fixing is shown in Table 1. In this example a dry, textile product web 2 of 100% polyester (PES) a product weight of 200 $G/M^2$ and a width of 2.2 m is fixed. The product web speed amounts to 100 m/min. Only the first stage is operated as a steam stage and thereby also the first field of the dryer is operated as a steam field.

The relative moisture of the steam stage is adjusted to the value 1 and the relative moistures of all remaining stages are adjusted to a predetermined value. For this purpose the relative moisture of the steam stage and at least a further stage are measured and the gas discharge quantity of the steam stage and at least one further stage are changed. In this example the relative moisture of the second stage is adjusted to 0.04 and the remaining stage to zero. The relative moistures of the treatment gasses of the first and second and of the both last stages in the corresponding fields 3 are measured and the discharge gas quantities of the first, second and the both last stages are changed by the adjusting devices of the discharge conduits 9 of the corresponding fields 3. The moisture sensor of the second field is connected through the switching area 14 with the adjusting unit 12 of the discharge conduit 9 of the second field.

The first field 3 of the dryer has a not shown steam supply, through which a quantity of 500 kg/h of heat steam is supplied to the dryer. By the withdrawing of the discharge gas quantities presented in the following table 1, namely a quantity of 300 kg/h of pure hot steam from the first stage (Table 1, field 1). A quantity of 5200 kg/h namely 200 kg/h hot steam and 5,000 kg/h of heated air from the second stage (field 2) and a quantity of 2000 kg/h heated air from the fifth stage (field 5) and a quantity of 1000 kg/h of heated air from the sixth stage (field 6), the established relative moisture of the stages are adjusted from one to six. For this purpose through the inlet lock 5 a quantity of fresh air of 8,000 kg/h is aspirated. The table 1 shows, in addition to the relative moistures and the discharge gas quantities, the air quantity available in the individual stages (fields) the evaporation which during fixing is generally zero, and the temperature of the treatment gasses which in all stages (fields) amounts to 190° C. By brackets, in table 1 it is further shown which moisture sensors are inactive, here there are the third and fourth stages (or in other words the third and fourth fields). The changing ability of the discharge quantities of the first, second, fifth and sixth stages and the corresponding fields is identified as "k" in the line of the discharge flap.

In this method the product web 2 is heated within one second to approximately 100° C. and fixed inside a few seconds. This makes possible a high product web speed and relatively shorter dryer.

| | Field 1 | Field 2 | Field 3 | Field 4 | Field 5 | Field 6 | |
|---|---|---|---|---|---|---|---|
| Temperature | 190 | 190 | 190 | 190 | 190 | 190 | |
| Evaporation, kg/h | 260 | 260 | 260 | 200 | 100 | 0 | 1080 |
| air in the field kg/h | 0 | 0 | 0 | 0 | 1000 | 2000 | 2000 |
| discharging gas: steam kg/h | 440 | 440 | ← | ←→ | 200 | 0 | 1080 |
| discharging gas: air kg/h | 0 | 0 | 0 | 0 | 1000 | 1000 | 2000 |
| rel. moisture x | 1 | 1 | 1 | 1 | 0.17 | 0 | — |
| moisture sensor | * | (*) | (*) | * | * | * | |
| discharge air flap | k | k | | | k | k | |

Table 2 illustrates drying.

In the example a textile product web 2 or 100% of cotten (BW) with a product weight of 200 g/m$^2$ and a width of 2.2 m is dried. The inlet moisture of the product web 2 amounts to 80% and its outlet moisture after the drying amounts to 8% (weight). The product web speed amounts to 60 m/min.

The first four stages are steam stages. Thereby the first four fields 3 of the dryer operate as steam fields.

The relative moisture of the four steam stages are adjusted to the value 1 and the relative moisture of the remaining stages are adjusted to a predetermined value. For this purpose the relative moisture of the first and fourth, or in other words the last steam stage and at least a further stage are measured and the discharge gas quantity of the first and second steam stages in at least one further stage are changed. In this example the relative moisture of the fifth stage is adjusted to 0.33 and in the sixth stage is adjusted to 0.09. The relative moistures of the treatment gas of the first, fourth and the both last stages in the corresponding fields 3 are measured, and the discharge quantities of the first, second and the both last stages are changed by the adjusting devices of the discharge gas conduits 9 of the corresponding fields 4. The moisture sensor of the fourth field 3 is connected through the switching unit 14 with the adjusting unit 12 of the discharge conduit 9 of the second field 3.

After starting, with the desired steam content in the first four stages produced by evaporation or by supply of steam, the established relative moistures of the stages are adjusted from one to six by the withdrawal of the gas quantities presented in the following table 2.

From the first stage (Table 2, Field 1) a quantity of 350 kg/h of pure hot steam, from the second stage (Field 2) also a quantity of 350/kg/h of pure hot steam, during the first stage (Field 5) a quantity of discharge gas of 840 kg/h, namely 280 kg/h of hot steam and 560 kg/h of heated air, and from the sixth stage (Field 6) a quantity of discharge gas of 1100 kg/h, namely 100 kg/h of hot steam and 1000 kg/h of heated air, are withdrawn. For this purpose through the outlet lock 5, a quantity of fresh air 1560 kg/h is aspirated. As Table 1, Table 2 also shows in addition to the relative moistures and the discharge gas quantities, the air quantities available in the individual stages (Fields) the evaporation and the temperature of the treatment gasses which in all stages (Fields) amounts to 180° C. By brackets in Table 2 it is shown which moisture sensors are inactive, here in the second and third stages (or in other words in the second and third fields). The changeability of the discharge quantities of the first, second, fifth and sixth stages and the corresponding fields is identified as "k" in the line of discharge flap.

The product web 2 is heated in the first steam stage to 100° C. It maintains this temperature during passage of the four steam stages while its moisture reduces. The product web 2 reaches an optimal shrinkage moisture at its high temperature, mainly in the third or fourth steam stages, whereby the shrinkage is very enhanced.

| | Field 1 | Field 2 | Field 3 | Field 4 | Field 5 | Field 6 | |
|---|---|---|---|---|---|---|---|
| Temperature | 190 | 190 | 190 | 190 | 190 | 190 | |
| Evaporation kg/h | 0 | 0 | 0 | 0 | 0 | 0 | — |
| air in field kg/h | 0 | 5000 | 5000 | 5000 | 7000 | 8000 | 8000 |
| discharge gas: steam kg/h | 300 | 200 | 0 | 0 | 0 | 0 | 500 |
| discharge gas: air kg/h | 0 | 5000 | ← | ← | 2000 | 1000 | 8000 |
| rel. moisture x | 1 | 0.04 | 0 | 0 | 0 | 0 | — |
| moisture sensor | * | * | (*) | (*) | * | * | |
| Discharge air flap | k | k | | | k | k | |

Drying and fixing are illustrated in table 3.

In this example a textile product web of 2 of 100% polyster (PES), with a product weight of 200 g/m$^2$ and a width of 2.2 m is dried and fixed. The textile product web 2 corresponds to the example 1 and has however in contrast to it, an input moisture of 80%. Its output moisture after the drying and fixing is reduced to 8%. The product web speed amounts to 40 m/min.

In the example for drying, the first four stages operate at seam stages and thereby the first four fields three of the dryer operate as steam fields. This example, drying and fixing differs from drying in that, the relative moistures of the fifth and sixth stages are adjusted to lower value, namely to 0.17 and 0. For adjustment of this relative moistures, after starting the following discharge gas quantities presented in the Table 2 are withdrawn: in the first and second stages (Table 3, Fields 1 and 2) correspondingly a quantity of 440 kg/h of hot steam, in the first stage (Field 5) a discharge gas quantity of 1200 kg/h namely 200 kg/h of hot steam and 1000 kg/h of heated air, and in the sixth stage (field 6) a quantity of 1000 kg/h heated air. The Table 3 shows in addition to the relative moistures and discharge gas quantities available in the individual stages (Fields), also the evaporation and the temperature of the treatment gasses which amount in all stages (Fields) to 190° C. In comparison with Tables 3 and 2 shows that during the drying and fixing in the first fields, a strong evaporation is adjusted. Also in Table 3 it is shown that the moisture sensors of the second and third stages (in other words the second and third fields) are inactive, and shows "k" in the line of discharge air flap the changeability of the discharge air quantities of the first, second, fifth and sixth stages.

The product web is dried and fixed, while the fixing is formed the sixth stage and ends substantially after 5 seconds.

| | Field 1 | Field 2 | Field 3 | Field 4 | Field 5 | Field 6 | |
|---|---|---|---|---|---|---|---|
| Temperature | 190 | 190 | 190 | 190 | 190 | 190 | |
| Evaporation kg/h | 0 | 0 | 0 | 0 | 0 | 0 | — |
| air in field kg/h | 0 | 5000 | 5000 | 5000 | 7000 | 8000 | 8000 |
| discharge gas: steam kg/h | 300 | 200 | 0 | 0 | 0 | 0 | 500 |

-continued

| | Field 1 | Field 2 | Field 3 | Field 4 | Field 5 | Field 6 | |
|---|---|---|---|---|---|---|---|
| discharge gas: air kg/h | 0 | 5000 | ← | ← | 2000 | 1000 | 8000 |
| rel. moisture x | 1 | 0.04 | 0 | 0 | 0 | 0 | — |
| moisture sensor | * | * | (*) | (*) | * | * | |
| Discharge air flap | k | k | | | k | k | |

Figure 2:
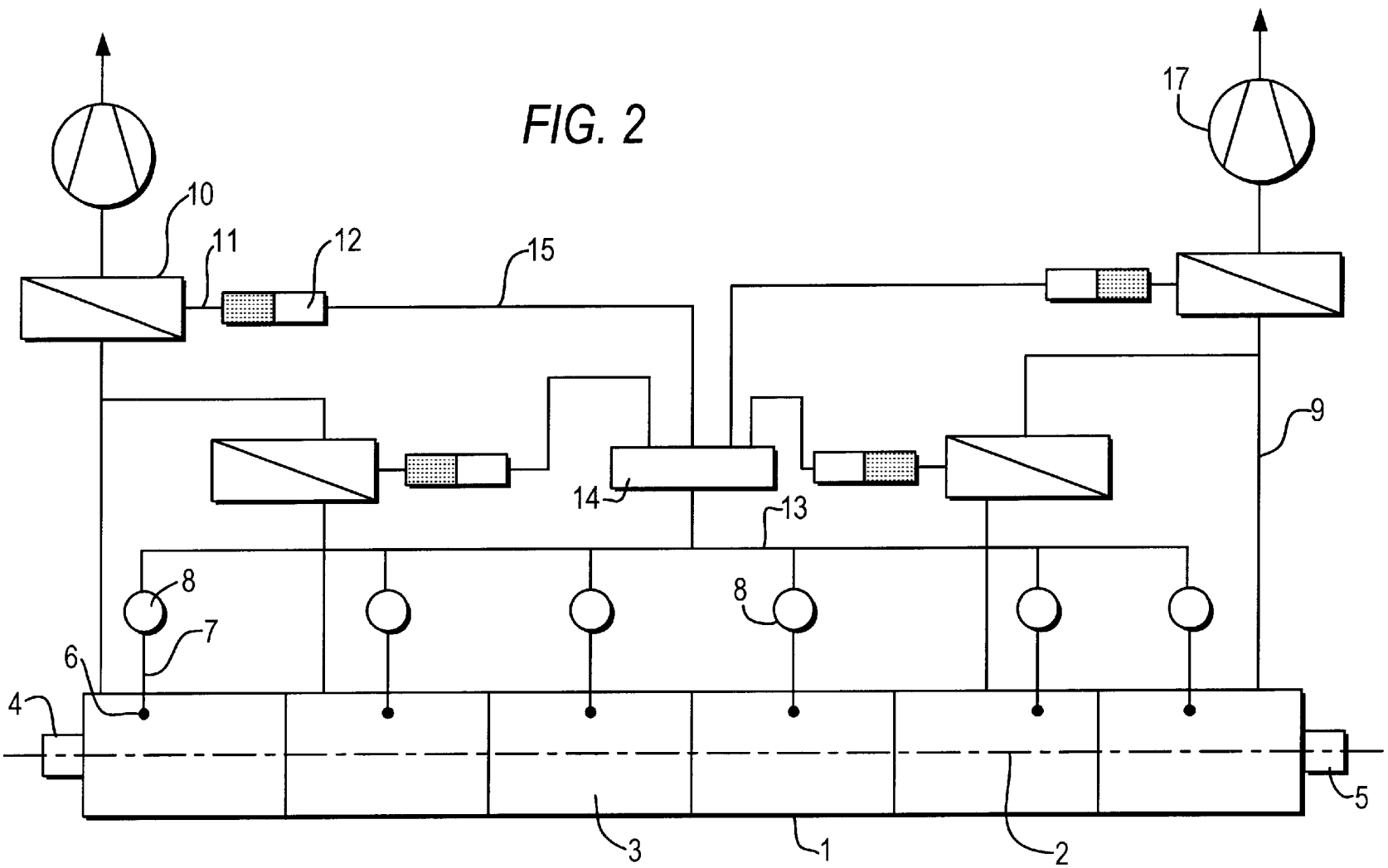
FIG. 2 is a view showing the dryer in accordance with a second embodiment with a central control.

A dryer in accordance with the second embodiment of the present invention is shown in FIG. 2 and substantially corresponds to the dryer of the embodiment shown in FIG. 1. Contrary to the dryer of FIG. 1 all moisture sensors arranged in each of the six fields 3 are connected to the switching unit 14. In other words the measuring devices 8 of the moisture sensors of the first-sixth Fields 3 are connected through conduits 13 with the switching unit 4. The switching unit 14 is connected by conduits 15 to the adjusting units 12 with all discharge conduits 9 of the dryer. A control or regulating unit with a microprocessor for central controlling or regulation of the dryer is connected to the switching unit 14. A control or regulating unit is not shown in FIG. 2.

In the embodiment shown in FIG. 2 the discharge gas conduit 9 of the second field 3 opens into the discharge conduit 9 of the first field 3, and in particular before its flap 10. Similarly the discharge gas conduit 9 of the pan ultimate, or in other words fifth, field 3 opens in the discharge conduit 9 of the last, or in other words sixth field 3, similarly before its flap 10.

The arrangement of the discharge gas conduits 9, in accordance with the embodiment 1 or the embodiment 2, is independent from the connection of the switching unit 14 with a part or all moisture sensors. The arrangement of the discharge gas conduits 9 of the dryer in accordance with the embodiment of FIG. 2 can be arranged simultaneously with the switching unit 14 shown in the embodiment of FIG. 1, in a dryer, and vice versa.

It will be understood that each of the elements described above, or two or more together, may also find a useful application in other types of methods and constructions differing from the types described above.

While the invention has been illustrated and described as embodied in method of continuous thermal treatment of a textile product web, and a dryer therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of continuos thermal treatment of a textile product web, comprising the steps of bringing a product web in contact with a treatment gas guided in a circulating process; introducing a product web into a steam portion having one or several steam stages in which heat steam is used as a treatment gas; introducing the product web into a steam-air portion which has one or several stages and hot steam and heated air as a treatment gas; passing the product web first through the steam portion and subsequently through the steam air portion; providing an exchange of the treatment gas between the steam stages and the stages; adjusting a relative moisture of the hot steam of the steam stages of the steam portion to the value zero; and performing the adjusting by measuring relative moistures of a first and a last steam stages and changing discharge gas quantities of the first or second steam stages and one further stage.

2. A method as defined in claim 1; and further comprising the steps of providing the steam portion with one steam stage; adjusting the relative moisture of the steam stage of the value 1 and relative moisture of all remaining stages to a predetermined value; and performing the adjusting by measuring relative moisture of the steam stages in at least one further stage and changing discharge gas quantity the steam stage and at least one further stage.

3. A method as defined in claim 1; and further comprising the steps of forming the steam portion with at least three steam stages; adjusting additionally the relative moistures of all further stages to a predetermined value; and performing the adjusting by measuring the moisture of at least one further stage and additionally changing the discharge gas quantity of at least one further steam stage or a further stage.

4. A method as defined in claim 3; and further comprising changing the discharge gas quantity of the first and second steam stage and at least one further stage.

5. A method as defined in claim 1; and further comprising changing the discharge quantity of a last stage.

6. A method as defined in claim 2; and further comprising adjusting the discharge quantity of last both stages.

7. A method as defined in claim 3; and further comprising the steps of measuring the relative moisture of four stages; and varying the discharge gas quantity of the four stages.

8. A method as defined in claim 1; and further comprising forming 10–80% of the stages as the seam stages of the steam portion.

9. A dryer for a continuous thermal treatment of a textile product web, comprising a steam-tight housing through which a product web is transportable; at least two successively arranged fields each provided with a circulating device for a treatment gas; moisture sensors arranged in first fields and in at least one rear field; a discharge conduit provided with an adjusting arrangement and arranged at least in a first or a second field and in at least one further field correspondingly; a switching unit through which at least two of said moisture sensors are connected; said switching unit being connected with at least one adjusting device.

10. A dryer as defined in claim 9, wherein said moisture sensors of said moisture sensors of said first field, and optionally said first fields, are connected with said switching unit.

11. A dryer as defined in claim 9, wherein all said fields are provided with said moisture sensors.

12. A dryer as defined in claim 11, wherein all said moisture sensors are connected with said switching unit, said switching unit being connected with said adjusting devices.

13. A dryer as defined in claim 9, wherein said first and said second field have a discharge gas conduit connected with said adjusting device.

14. A dryer as defined in claim 9, wherein the last field has a discharge conduit connected with said adjusting device.

15. A dryer as defined in claim 13, wherein additionally a pan ultimate field has a discharge conduit connected with said adjusting device.

* * * * *